US010012232B2

(12) United States Patent
Kim et al.

(10) Patent No.: US 10,012,232 B2
(45) Date of Patent: Jul. 3, 2018

(54) COMPRESSOR

(71) Applicant: LG ELECTRONICS INC., Seoul (KR)

(72) Inventors: Pilhwan Kim, Seoul (KR); Changjun Noh, Seoul (KR); Hanseob Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 413 days.

(21) Appl. No.: 14/734,743

(22) Filed: Jun. 9, 2015

(65) Prior Publication Data

US 2015/0377237 A1 Dec. 31, 2015

(30) Foreign Application Priority Data

Jun. 27, 2014 (KR) ..... 10-2014-0080055

(51) Int. Cl.
*F04C 29/12* (2006.01)
*F04C 18/356* (2006.01)
(Continued)

(52) U.S. Cl.
CPC ..... *F04C 29/12* (2013.01); *F04C 18/356* (2013.01); *F04C 18/3564* (2013.01);
(Continued)

(58) Field of Classification Search
CPC .. F04C 23/008; F04C 18/3564; F04C 23/001; F04C 18/356; F04C 18/3568; F04C 27/001; F04C 29/12; F25B 1/04
See application file for complete search history.

(56) References Cited

U.S. PATENT DOCUMENTS

2002/0012595 A1* 1/2002 Kouno ..... F04B 39/1013 417/559
2009/0074600 A1* 3/2009 Shimizu ..... F04C 18/045 418/55.2
(Continued)

FOREIGN PATENT DOCUMENTS

CN 101008389 A 8/2007
CN 201747614 U 2/2011
(Continued)

OTHER PUBLICATIONS

JP 2007198319 English Language machine translation.*

*Primary Examiner* — Mark Laurenzi
*Assistant Examiner* — Wesley Harris
(74) *Attorney, Agent, or Firm* — Dentons US LLP

(57) ABSTRACT

A compressor includes: a compression space with an annular shape comprising an inner circumferential surface and an outer circumferential surface; and a discharge opening formed in a direction parallel to a shaft direction of the compressor, to discharge a refrigerant compressed in the compression space, wherein a first portion of a cross-sectional area of the discharge opening overlaps a portion of a cross-sectional area of the compression space, a second portion of the cross-sectional area of the discharge opening does not overlap the cross-sectional area of the discharge opening, and the ratio of the non-overlapping second portion of the cross-sectional area of the discharge opening to the entire cross-sectional area of the discharge opening is 0.1 or less. With such a configuration, a dead volume generated in the compression space can be reduced, and thus compressor efficiency can be enhanced.

13 Claims, 8 Drawing Sheets

(51) Int. Cl.

| | |
|---|---|
| ***F04C 23/00*** | (2006.01) |
| ***F25B 1/04*** | (2006.01) |
| ***F04C 27/00*** | (2006.01) |

(52) U.S. Cl.
CPC ..... *F04C 18/3568* (2013.01); *F04C 23/001* (2013.01); *F04C 23/008* (2013.01); *F04C 27/001* (2013.01); *F25B 1/04* (2013.01)

(56) References Cited

U.S. PATENT DOCUMENTS

| | | | | |
|---|---|---|---|---|
| 2009/0180912 | A1* | 7/2009 | Morozumi ..... | F04C 18/3564<br>418/229 |
| 2012/0087819 | A1 | 4/2012 | Shimizu et al. | |

FOREIGN PATENT DOCUMENTS

| | | | | | |
|---|---|---|---|---|---|
| CN | 102859200 | A | | 1/2013 | |
| CN | 203453060 | U | | 2/2014 | |
| DE | 10009673 | A1 | | 9/2000 | |
| EP | 2306026 | A2 | | 4/2011 | |
| EP | 2407668 | A2 | | 1/2012 | |
| EP | 2708752 | A1 | | 3/2014 | |
| JP | 5-133363 | A | | 5/1993 | |
| JP | 2007198319 | A | * | 8/2007 | ..... F04C 18/356 |

* cited by examiner

COMPRESSOR

CROSS-REFERENCE TO RELATED APPLICATION

Pursuant to 35 U.S.C. § 119(a), this application claims the benefit of earlier filing date and right of priority to Korean Application No. 10-2014-0080055, filed on Jun. 27, 2014, the contents of which is incorporated by reference herein in its entirety.

BACKGROUND

1. Field

The present disclosure relates to a compressor, and more particularly, to a discharge opening of a compressor.

2. Background

Generally, a compressor is applied to a vapor compression-type refrigerating cycle (hereinafter a refrigerating cycle) such as a refrigerator or an air conditioner. A compressor may be an inverter type compressor having a controllable rotation speed or a constant speed type compressor having a constant rotation speed.

The compressor can be classified as a hermetic type compressor, where a motor part and a compression part operated by the motor part are installed at an inner space of a hermetic casing, or as an open type compressor, where a motor part is additionally installed outside a casing. In refrigerating devices for home use or business use, the hermetic type compressor is mainly used.

The compressor may be categorized as a rotary compressor or a reciprocating compressor according to the method used to compress a refrigerant. The rotary compressor is a type of compressor that varies a volume of a compression space while a piston performs a rotation motion or an orbital motion in a cylinder. In contrast, the reciprocating compressor is a type of compressor that varies a volume of a compression space while a piston performs a reciprocating motion in a cylinder.

In most compressors, including the rotary compressor and the reciprocating compressor, a large or small dead volume may be created while a refrigerant is sucked, compressed and discharged. In particular, a dead volume created when a refrigerant is discharged from a compression space may greatly affect compressor efficiency. Thus, to achieve optimal compressor efficiency, it is important to minimize the dead volume that may be created when a refrigerant is discharged.

A dead volume of the compressor may be created on a flow path. In particular, a dead volume created while a refrigerant is discharged is closely related to an area and a length of a discharge opening. Thus, it is preferable to optimize the area of the discharge opening, and to minimize the length of the discharge opening, in order to reduce a discharge dead volume of the compressor.

A position and a shape of the discharge opening are also closely related to a discharge dead volume of the compressor. If the discharge opening is disposed at a position far from a compression space, a connection passage for connecting the discharge opening and the compression space with each other can be required, and the connection passage may serve as a dead volume. Thus, it is preferable to reduce a discharge dead volume by avoiding a connection passage by narrowing a distance between the compression space and the discharge opening as much as possible. However, in this instance, it is preferable to obtain a required discharge area by optimizing a shape of the discharge opening.

FIG. 1 is a longitudinal section view of a rotary compressor in accordance with the conventional art, FIG. 2 is a longitudinal section view illustrating a position of a discharge opening of FIG. 1, and FIG. 3 is a planar view illustrating a shape of the discharge opening of FIG. 2.

As shown, in the conventional rotary compressor, a motor part 2 is installed in a compressor casing 1, and a compression part 3 is installed below the motor part 2. The motor part 2 and the compression part 3 are mechanically connected to each other by a crank shaft 23.

The motor part 2 may include a stator 21 forcibly-fixed to the inside of the compressor casing 1, a rotor 22 rotatably-inserted into the stator 21, and a crank shaft 23 coupled to a central part of the rotor 22 by being forcibly-inserted thereinto.

The compression part 3 includes a main bearing 31 and a sub bearing 32 fixed to the compressor casing 1 with a distance therebetween so as to support the crank shaft 23, a cylinder 33 installed between the main bearing 31 and the sub bearing 32 and forming a compression space (S), and a rolling piston 34 coupled to an eccentric portion 23*a* of the crank shaft 23, and configured to compress a refrigerant while performing an orbital motion in a compression space 33*a* of the cylinder 33.

A suction opening 33*a* is penetratingly-formed at the cylinder 33 in a radial direction, and a refrigerant pipe 4 which forms a suction pipe by passing through the compressor casing 1 is connected to the suction opening 33*a*. A vane slot 33*b* for slidably inserting a vane 35 is formed at the cylinder 33 at one side of the suction opening 33*a* in a circumferential direction. A discharge guide groove 33*c* for guiding a refrigerant to a discharge opening 31*a* of the main bearing 31 is formed at one side of the vane slot 33*b*, i.e., a side opposite to the suction opening 33*a*, as shown in FIG. 2. The discharge guide groove 33*c* is formed to have an inclined sectional surface so that a sectional area is gradually increased toward an upper surface of the cylinder 33. Thus, as shown in FIG. 3, the discharge opening 31*a* of the main bearing 31 is formed at an overlapping position with the discharge guide groove 33*c*, in a perfect circle shape. The discharge guide groove 33*c* is formed so that about at least 30% of an entire sectional area thereof is positioned outside the compression space (S).

Reference numeral 11 denotes a suction pipe, 12 denotes a discharge pipe, 31*b* denotes a sealing protrusion, and 36 denotes a discharge valve.

In the conventional rotary compressor, if the rotor 22 of the motor part 2 and the crank shaft 23 are rotated as power is supplied to the motor part 2, a refrigerant is sucked into the compression space (S) of the cylinder 33 as the rolling piston 34 performs an orbital motion. The refrigerant is then repeatedly compressed by the rolling piston 34 and the vane 35, and is discharged to an inner space of the compressor casing 1 through the discharge opening 31*a* of the main bearing 31.

However, the conventional rotary compressor may have the following problems.

Firstly, the discharge guide groove 33*c* and the discharge opening 31*a* serve as a dead volume because a compressed refrigerant remains therein. This may lower compressor efficiency. In particular, the discharge guide groove 33*c* is configured to guide a refrigerant inside the compression space (S) to the discharge opening 31*a*. If the discharge guide groove 33*c* is removed, a proper area of a discharge passage cannot be obtained. This may cause over-compression and discharge loss due to the over-compression. In order to solve such problem, the discharge opening 31*a* may be moved toward a central part of the cylinder, by a sectional area of the discharge guide groove 33*c*, in a state where a diameter (D5) of the discharge opening 31*a* is maintained. However, in this instance, an installation space of a discharge valve is not sufficient, or a shaft accommodation portion of the main bearing is penetrated. This may lower reliability of a bearing.

SUMMARY

Therefore, an aspect of the detailed description is to provide a compressor capable of preventing over-compression.

Another aspect of the detailed description is to provide a compressor capable of obtaining high efficiency by minimizing a dead volume.

Another aspect of the detailed description is to provide a compressor capable of removing a discharge guide groove on a flow path along which a refrigerant compressed in a compression space is discharged.

Another aspect of the detailed description is to provide a compressor capable of smoothly discharging a refrigerant compressed in a compression space, without a discharge guide groove.

To achieve these and other advantages and in accordance with the purpose of this specification, as embodied and broadly described herein, there is provided a compressor, including: a compression space with an annular shape comprising an inner circumferential surface and an outer circumferential surface; and a discharge opening formed in a direction parallel to a shaft direction of the compressor, and configured to discharge a refrigerant compressed in the compression space, wherein at least a portion of a cross-sectional area of the discharge opening overlaps at least a portion of a cross-sectional area of the compression space, and wherein the ratio of the non-overlapping portion of the cross-sectional area of the discharge opening to the entire cross-sectional area of the discharge opening is 0.1 or less.

The discharge opening may be formed in a direction parallel to a shaft direction of the compressor, and may have a non-perfect circle shape elongated along one cross-sectional direction.

An annular piston member, which forms an inner circumferential surface of the compression space, and which compresses a refrigerant while performing an orbital motion by contacting an outer circumferential surface of the compression space, may be provided at the compression space. A width of the discharge opening in a short-axis direction may be 1.1 times or less than a sealing thickness of the piston member in a radial direction.

An annular piston member, which forms an inner circumferential surface of the compression space, and which compresses a refrigerant while performing an orbital motion by contacting an outer circumferential surface of the compression space, may be provided at the compression space. A maximum interval between the outer circumferential surface of the compression space and an inner circumferential surface of the discharge opening may be equal to or less than a sealing thickness of the piston member in a radial direction.

The discharge opening may be formed such that a cross-sectional area at an inlet thereof is larger than a cross-sectional area at an outlet thereof.

The discharge opening may be formed in plurality.

To achieve these and other advantages and in accordance with the purpose of this specification, as embodied and broadly described herein, there is also provided a compressor, including: a cylinder with compression space in an annular shape; a rolling piston with an annular shape, and configured to compress a refrigerant while performing an orbital motion in the compression space when an outer circumferential surface thereof contacts an inner circumferential surface of the cylinder; a vane slidably inserted into the cylinder, and configured to divide the compression space into a suction chamber and a discharge chamber when the vane contacts the rolling piston; and a plurality of bearings forming the compression space by coupling to upper and lower sides of the cylinder, and having a discharge opening on at least one side thereof, wherein a refrigerant compressed in the compression space is discharged through the discharge opening, and wherein a ratio of a width of the discharge opening in a radial direction to a sealing thickness of the rolling piston in a radial direction is 1.1 or less.

A cross-sectional area of the discharge opening positioned outwards from the inner circumferential surface of the cylinder and blocked by the cylinder may be 10% or less than an entire cross-sectional area of the discharge opening.

A maximum interval between the inner circumferential surface of the cylinder and an inner circumferential surface of the discharge opening may be equal to or less than a sealing thickness of the piston member in a radial direction.

The discharge opening may be elongated along one cross-sectional direction.

The discharge opening may have a circular shape, and a cross-sectional area of an inlet of the discharge opening may be smaller than a cross-sectional area of an outlet of the discharge opening.

An edge of the inner circumferential surface of the cylinder may contact the bearing having the discharge opening and may have a circular shape.

An edge of the inner circumferential surface of the cylinder may contact the bearing having the discharge and may have a single inner diameter.

To achieve these and other advantages and in accordance with the purpose of this specification, as embodied and broadly described herein, there is also provided a compressor, including: a cylinder with a compression space in an annular shape; a rolling piston formed in an annular shape, and configured to compress a refrigerant while performing an orbital motion in the compression space when an outer circumferential surface thereof contacts an inner circumferential surface of the cylinder; a vane slidably inserted into the cylinder, and configured to divide the compression space into a suction chamber and a discharge chamber when the vane contacts the rolling piston; and a plurality of bearings forming the compression space by coupling to upper and lower sides of the cylinder, and having a discharge opening on at least one side thereof, wherein a refrigerant compressed in the compression space is discharged through the discharge opening, and wherein an edge of the inner circumferential surface of the cylinder contacts the bearing having the discharge opening and has a circular shape.

An edge of the inner circumferential surface of the cylinder contacts the bearings-having the discharge opening and has a single inner diameter.

The scroll compressor of the present disclosure can have the following advantages.

Even if the discharge opening is formed within a range of the compression space in a radial direction, or even if part of the discharge opening is formed out of the range of the compression space in a radial direction, most of the discharge opening is positioned within the range of the compression space in a radial direction. Thus, a discharge guide groove needs not be additionally formed at the cylinder. As a discharge guide groove which generates a dead volume is removed from the cylinder, a dead volume of the compressor is reduced to enhance compressor efficiency.

Further scope of applicability of the present application will become more apparent from the detailed description provided hereinafter. However, it should be understood that the detailed description and specific examples, while indicating preferred embodiments of the disclosure, are provided by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION

Description will now be given in detail of preferred configurations of a scroll compressor according to the present disclosure, with reference to the accompanying drawings.

Figure 1:
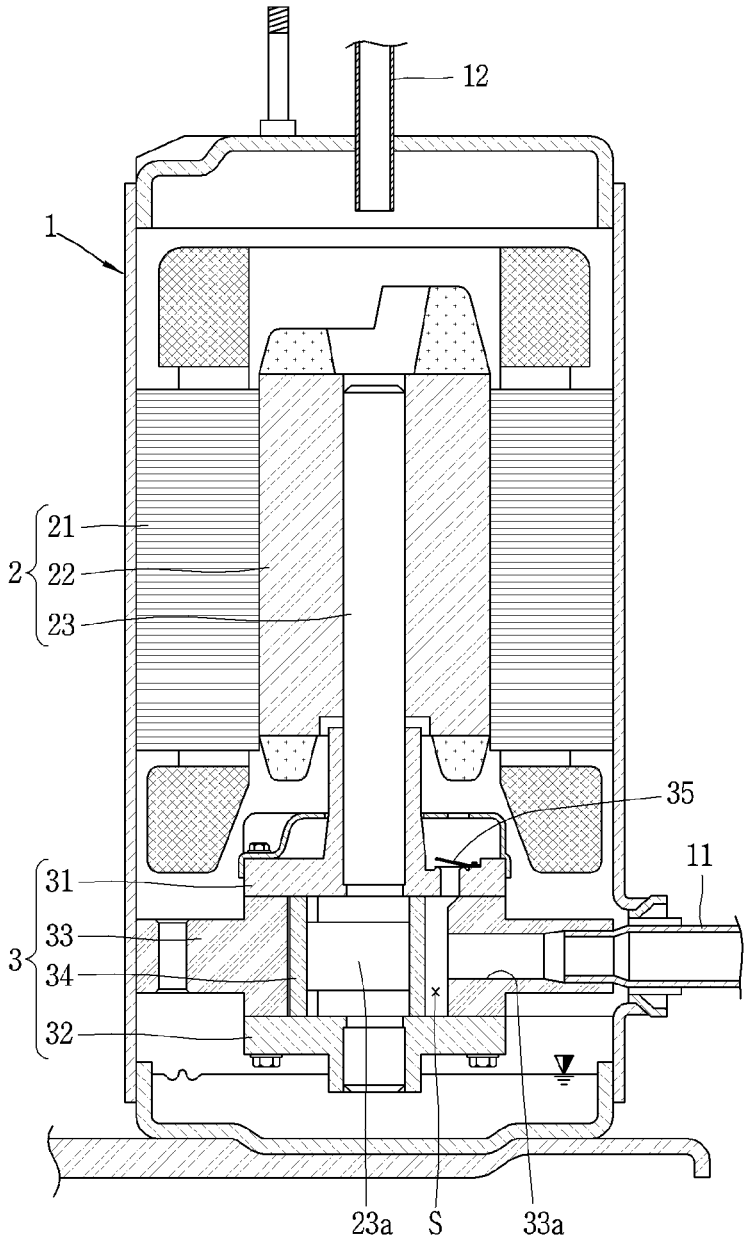
FIG. 1 CONVENTIONAL ART
FIG. 1 is a longitudinal section view of a rotary compressor in accordance with the conventional art.
Figure 2:
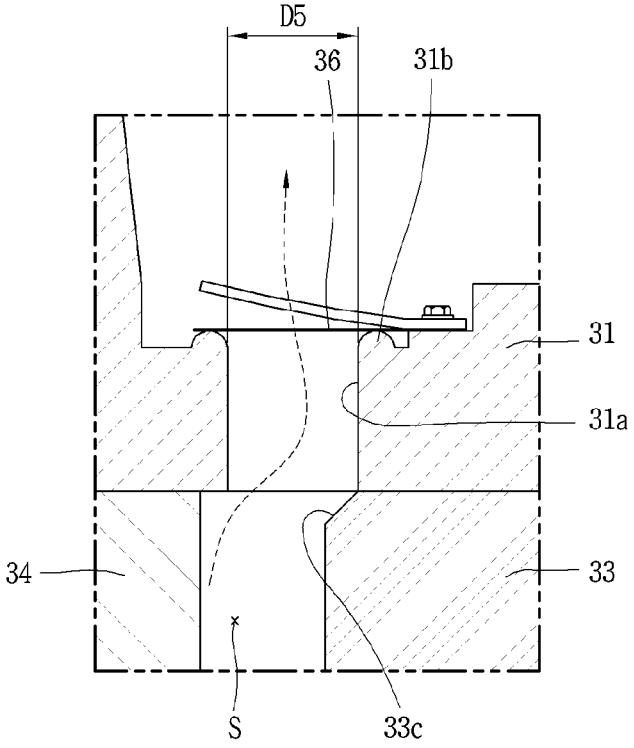
FIG. 2 CONVENTIONAL ART
FIG. 2 is a longitudinal section view illustrating a position of a discharge opening of FIG. 1.
Figure 3:
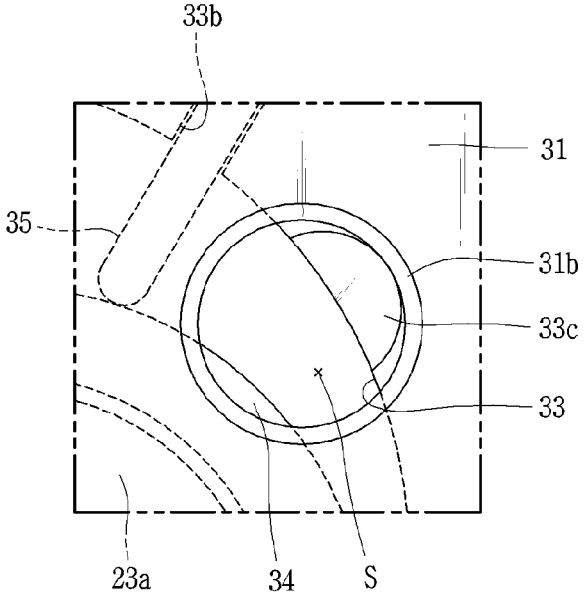
FIG. 3 CONVENTIONAL ART
FIG. 3 is a planar view illustrating a shape of the discharge opening of FIG. 2.
Figure 4:
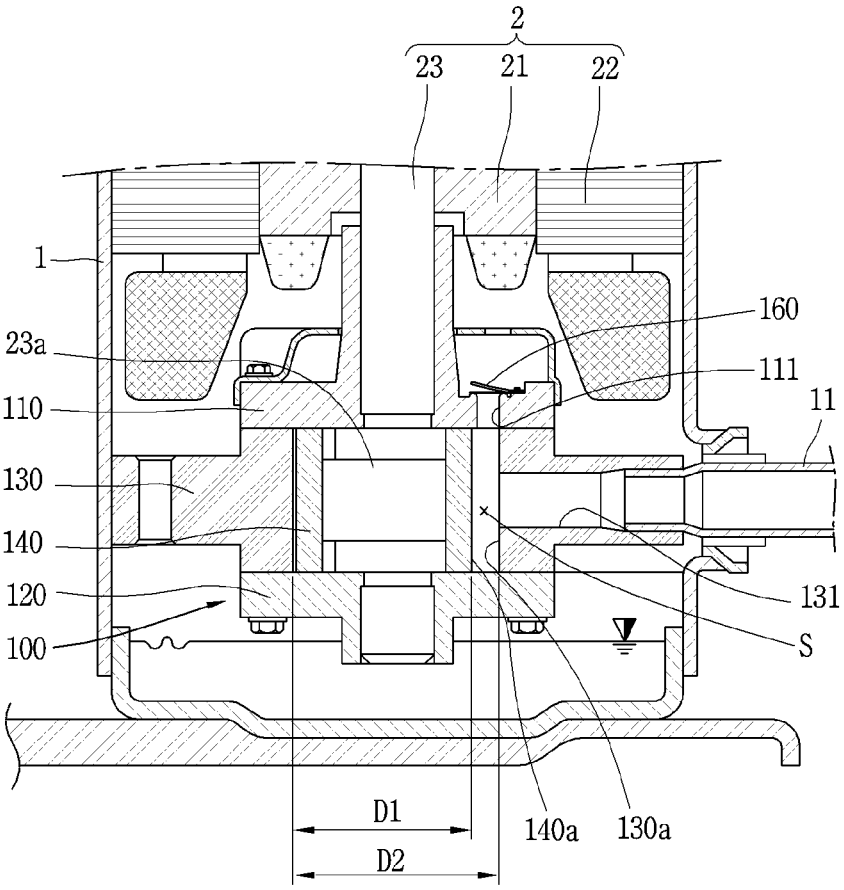
FIG. 4 is a longitudinal section view illustrating a compression part of a rotary compressor according to the present disclosure.

FIG. 4 is a longitudinal section view illustrating a compression part of a rotary compressor according to the present disclosure.

Referring to FIG. 4, in the rotary compressor according to the present disclosure, a motor part 2 may be installed in a compressor casing 1, and a compression part 100 may be installed below the motor part 2. The motor part 2 and the compression part 100 may be mechanically connected to each other by a crank shaft 23.

The motor part 2 may include a stator 21 forcibly-fixed to the inside of the compressor casing 1, a rotor 22 rotatably-inserted into the stator 21, and a crank shaft 23 coupled to a central part of the rotor 22 by being forcibly-inserted thereinto.

As shown in FIG. 4, the compression part 100 may include a main bearing 110 and a sub bearing 120 fixedly-coupled to the compressor casing 1 so as to support the crank shaft 23, a cylinder 130 installed between the main bearing 110 and the sub bearing 120 and forming a compression space (S), a rolling piston 140 coupled to an eccentric portion 23*a* of the crank shaft 23, and configured to compress a refrigerant while performing an orbital motion in the cylinder 130, and a vane (refer to FIG. 9) 150 configured to divide the compression space (S) into a suction chamber and a discharge chamber by contacting an outer circumferential surface of the rolling piston 140.

A discharge opening 111, through which a refrigerant compressed in the compression space (S) is discharged to an inner space of the casing 1, may be formed at the main bearing 110 so as to communicate with the compression space (S). A discharge valve 160 for opening and closing the discharge opening 111 may be installed on an upper surface of the main bearing 110.

The cylinder 130 may be formed in an annular shape having an inner circumferential surface of a perfect circle shape. An inner diameter (D1) of the cylinder 130 is formed to be larger than an outer diameter (D2) of the rolling piston 140, such that the compression space (S) is formed between an inner circumferential surface 130*a* of the cylinder 130 and an outer circumferential surface 140*a* of the rolling piston 140. That is, the inner circumferential surface 130*a* of the cylinder 130 may form an outer wall surface of the compression space (S), and the outer circumferential surface 140*a* of the rolling piston 140 may form an inner wall surface of the compression space (S). As the rolling piston 140 performs an orbital motion, the outer wall surface of the compression space (S) forms a fixed wall whereas the inner wall surface of the compression space (S) forms a variable wall.

A suction opening 131 may be penetratingly-formed at the cylinder 130 in a radial direction, and a suction pipe 11 may be connected to the suction opening 131 by passing through the compressor casing 1. A vane slot 132 for slidably inserting the vane 150 may be formed at the cylinder 130 at one side of the suction opening 131 in a circumferential direction. A discharge guide groove for guiding a refrigerant to the discharge opening 111 of the main bearing 110 may be formed at one side of the vane slot 132, i.e., a side opposite to the suction opening 131. However, it is preferable not to form a discharge guide groove, since the discharge guide groove generates a dead volume. In the case that a discharge guide groove is formed, it is preferable to form it with a minimal volume so that compressor efficiency can be enhanced by a dead volume. In the case that no discharge guide groove is formed, either of two edges of an inner circumferential surface of the cylinder, i.e., an edge contacting a bearing having the discharge opening, may be formed in a circular shape having a single inner diameter.

In the case that the discharge guide groove is not formed at the cylinder 130 or the discharge guide groove is formed with a minimal volume, the discharge opening 111 for smoothly discharging a refrigerant inside the compression space (S) is preferably formed as follows. In particular, the discharge opening 111 is formed so that an entire portion of the cross-sectional area thereof can overlap with a range of a cross-sectional area of the compression space (S), or so that a maximum portion of the cross-sectional area of the discharge opening among an entire cross-sectional area thereof can overlap with the cross-sectional area of the compression space (S) while a remaining portion of the cross-sectional area of thereof is positioned in a non-overlapping manner with the compression space (S). This can minimize over-compression.

Figure 5:
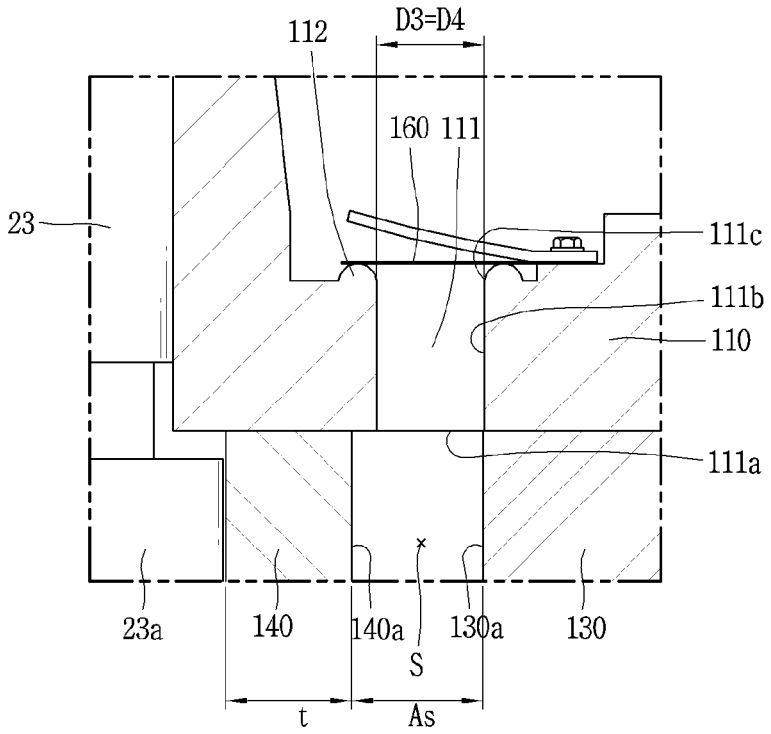
FIG. 5 is a schematic view illustrating a position of a discharge opening of FIG. 4.

FIG. 5 is a schematic view illustrating a position of the discharge opening of FIG. 4. As shown, the discharge opening 111 according to this embodiment may be formed such that an inlet 111*a* thereof is entirely positioned within a cross-sectional area of the compression space (S), i.e., such that an inner circumferential surface 111*b* of the discharge opening 111, which is farthest from a central part of the cylinder 130, contacts the inner circumferential surface 130*a* of the cylinder 130, or the inner circumferential surface 111*b* of the discharge opening 111 is positioned at an inner side than the inner circumferential surface 130*a* of the cylinder 130. With such a configuration, the conventional discharge guide groove needs not be formed at the cylinder 130. Thus, a dead volume due to the discharge guide groove can be prevented.

Figure 6:
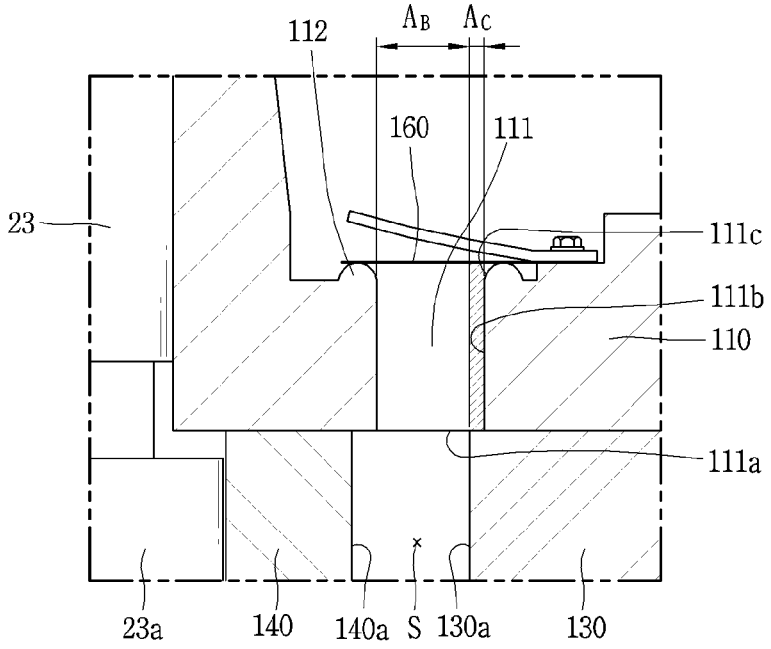
FIG. 6 is a schematic view illustrating another embodiment with respect to a position of the discharge opening of FIG. 5.

In some cases, as shown in FIG. 6, the discharge opening 111 may be formed such that portion ($A_C$) of an entire cross-sectional area thereof is formed in a non-overlapping manner outside the inner circumferential surface 130*a* of the cylinder 130, i.e., such that the portion ($A_C$) is positioned in a state blocked by the cylinder. In such a case, it is preferable that at least 90% of the entire cross-sectional area of the discharge opening 111 overlaps with the compression space (S). That is, it is preferable that portion ($A_B$) corresponding to about 85%-95% of the entire cross-sectional area of the discharge opening 111 is formed at an inner side than the inner circumferential surface 130*a* of the cylinder 130, and portion ($A_C$) corresponding to about 5%-15% of the entire cross-sectional area of the discharge opening 111 is formed at an outer side than the inner circumferential surface 130*a* of the cylinder 130. With such a configuration, a dead volume can be reduced because no discharge guide groove is formed, and a refrigerant can be smoothly discharged.

Figure 7:
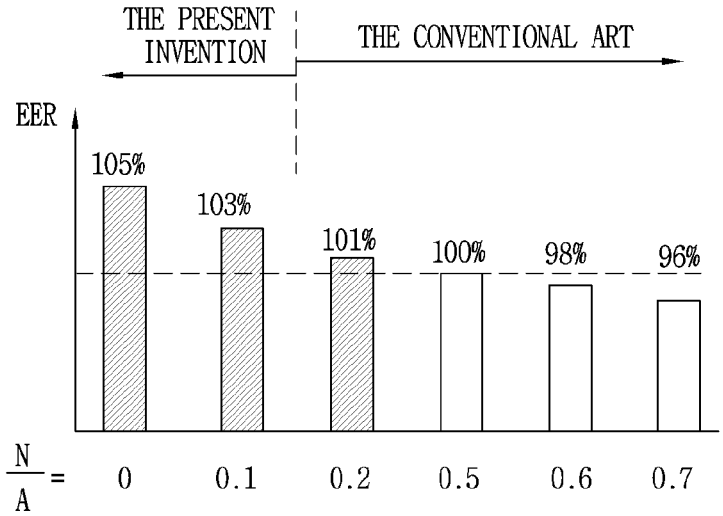
FIG. 7 is a graph illustrating a compressor efficiency (EER) according to a ratio (N/A) of a cross-sectional area (N) of a discharge opening positioned outward from a compression space, with respect to an entire cross-sectional area (A) of the discharge opening of the present disclosure.

FIG. 7 is a graph illustrating compressor efficiency (EER) according to a ratio (N/A) of a cross-sectional area (N) of a discharge opening which is positioned outside of a compression space, with respect to an entire cross-sectional area (A) of the discharge opening of the present disclosure. As shown, under an assumption that compressor efficiency is 100% when the ratio (N/A) is 0.5, the compressor efficiency is significantly decreased when the ratio (N/A) is 0.1 or more. On the other hand, the compressor efficiency is increased when the ratio (N/A) is 0.1 or less. In particular, it can be shown that the compressor efficiency is not significantly increased when the ratio (N/A) is within a range of 0.50.2, whereas the compressor efficiency is significantly increased when the ratio (N/A) is 0.1 or less. Thus, it is preferable to form the discharge opening so that the ratio (N/A) is 0.1 or less.

Figure 8:
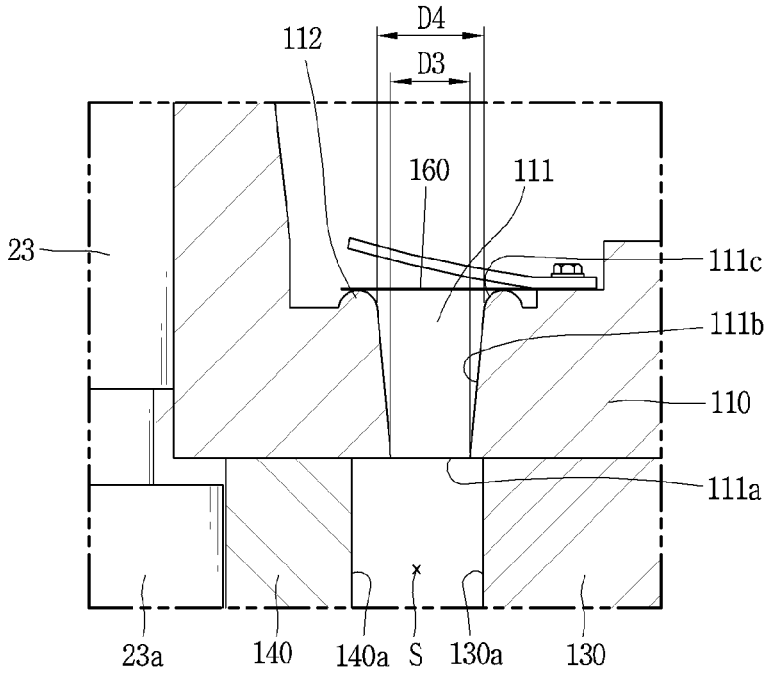
FIG. 8 is a longitudinal section view illustrating another embodiment of a discharge opening of FIG. 4.

As shown in FIG. 5, the discharge opening 111 may be formed to have a cross-sectional pillar shape where an inner diameter (D3) of the inlet 111*a* thereof is the same as an inner diameter (D4) of an outlet 111*c*. Alternatively, as shown in FIG. 8, the discharge opening 111 may be formed to have a tapered cross-sectional shape where the inner diameter (D4) of the outlet 111*c* is larger than the inner diameter (D3) of the inlet 111*a*. Thus, the inner circumferential surface 111*b* of the discharge opening 111 is formed as an inclined surface extending toward the outlet 111*c* between the inlet 111*a* and the outlet 111*c*. With such a configuration, a refrigerant can be rapidly discharged by being guided to the outlet 111*c* along the inclined inner circumferential surface 111*b* of the discharge opening 111. When the discharge opening 111 is formed with a width within a range of the compression space (S) (precisely, inside of an inner circumferential surface of the cylinder), the inner diameter (D3) of the inlet of the discharge opening 111 may not be increased due to standards of the compressor. In this case, over-compression may be minimized by increasing a discharge speed of a refrigerant by forming a small inner diameter (D3) of the inlet of the discharge opening 111, and by forming a large inner diameter (D4) of the outlet of the discharge opening 111. Further, as shown in the structure of FIG. 8, as the inner diameter (D4) of the outlet 111*c* of the discharge opening 111 is increased, a discharge pressure of a refrigerant is evenly distributed to the discharge valve 160. As a result, an opening speed of the discharge valve 160 can be increased, and noise generated from the discharge valve 160 can be minimized by supporting a wide area when the discharge valve 160 is closed.

Figure 9:
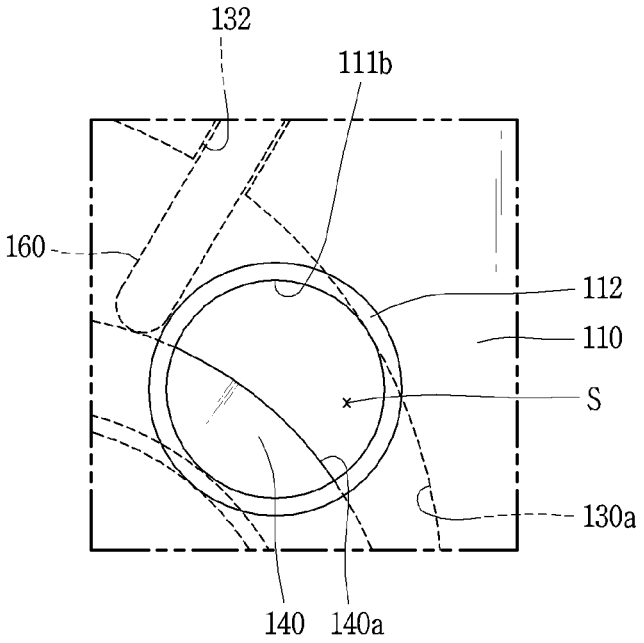
FIGS. 9 to 12 are planar views illustrating other embodiments of a discharge opening of FIG. 4.

The discharge opening may have various cross-sectional shapes. For instance, as shown in FIG. 9, the discharge opening 111 may have a cross-sectional shape in the conventional perfect circle shape. Processing of the discharge opening 111 may be most facilitated in such a case. However, if the discharge opening 111 has a cross-sectional surface in the conventional perfect circle shape, it is difficult to form the discharge opening 111 at a position inner then the inner circumferential surface 130*a* of the cylinder 130, i.e., within the compression space (S) in a radial direction, due to a large inner diameter of the discharge opening 111. That is, since the compression space (S) is composed of the inner circumferential surface 130*a* of the cylinder 130 and the outer circumferential surface 140*a* of the rolling piston 140, a width of the compression space (S) in a radial direction is not wide relative of an orbital motion of the rolling piston 140. However, if the inner diameter of the discharge opening 111 is too small, a refrigerant is not rapidly discharged. This may cause a lowering of compressor efficiency due to over-compression.

Figure 10:
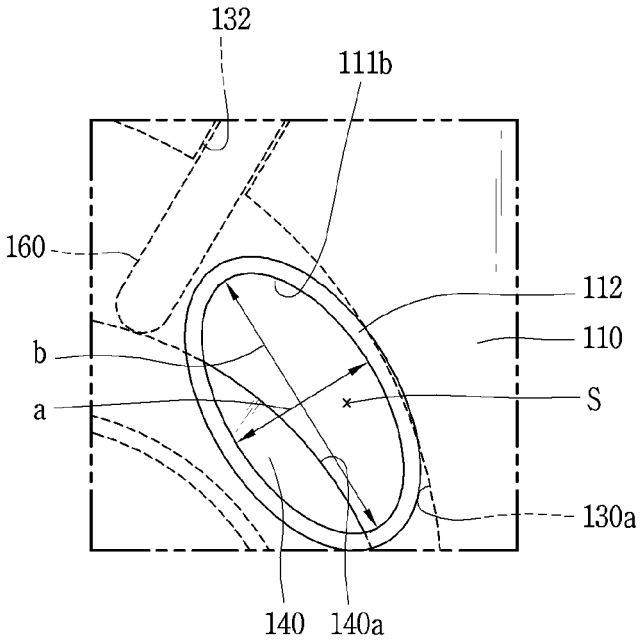
Figure 11:
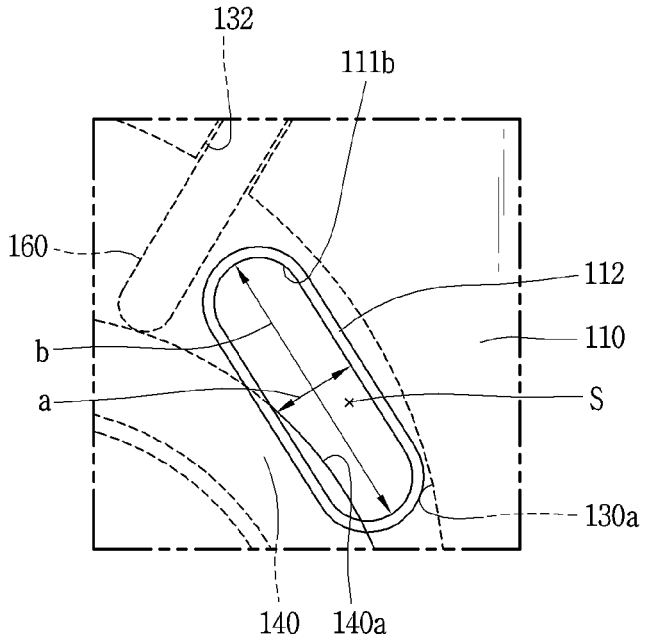

To solve such a problem, as shown in FIG. 10, the discharge opening 111 may be formed to have a cross-sectional elongated along one direction (slit shape), e.g., an oval cross-sectional shape. Alternatively, the discharge opening 111 may be formed to have a cross-sectional shape of a slit shape shown in FIG. 11, or a circular arc shape (not shown), such that a proper cross-sectional area is obtained while a width of the discharge opening in a radial direction is minimized. In these cases, the discharge opening 111 may be formed such that a cross-sectional short axis (a) thereof is positioned in a radial direction, and a cross-sectional long axis (b) thereof is positioned in a direction perpendicular to the radial direction (approximately, a circumferential direction).

Figure 12:
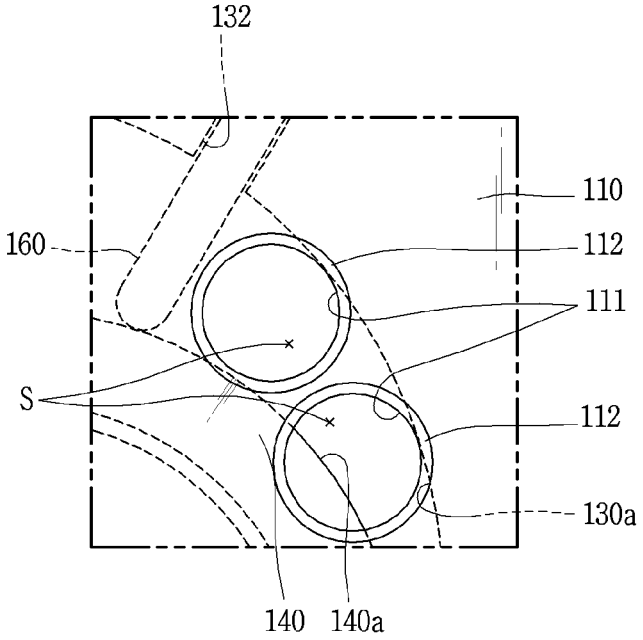

If the discharge opening 111 is formed in an oval shape, a slit shape or a circular arc shape, a width of the discharge opening 111 in a radial direction is narrowed. This can allow the discharge opening to be easily positioned within a range of the compression space (S). The same effect can be anticipated even in a case where a plurality of discharge openings 111 are arranged in a circumferential direction as shown in FIG. 12. That is, if the discharge opening 111 is formed in plurality, each discharge opening 111 can be formed within a range of the compression space (S), because an inner diameter of each discharge opening is reduced.

Figure 13:
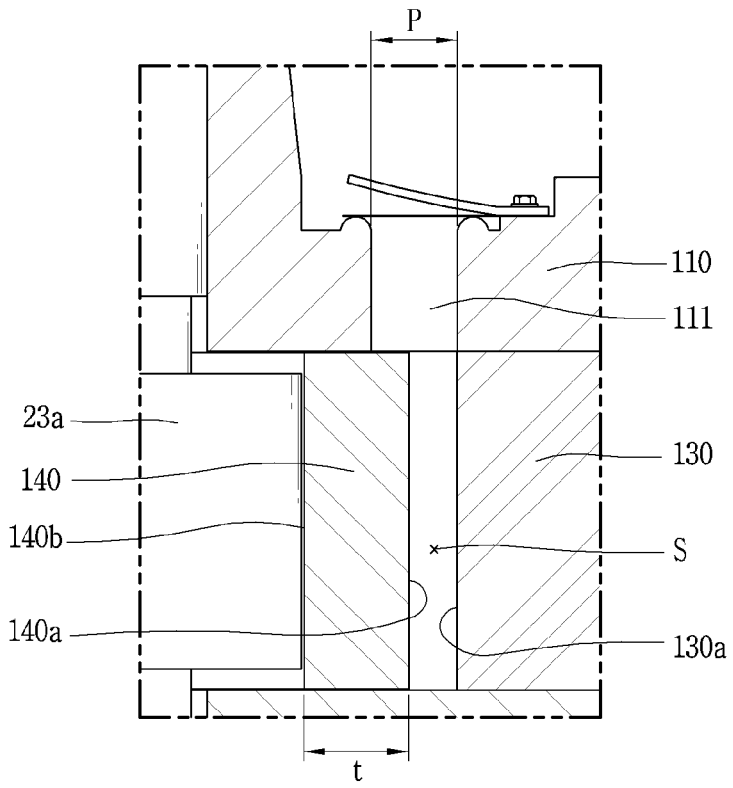
FIG. 13 is a longitudinal section view illustrating a relation between a rolling piston and a discharge opening in the rotary compressor of FIG. 4.

In a case where the discharge opening 111 has a cross-sectional shape of an oval shape or a slit shape as well as of a perfect circle shape, a width of the discharge opening 111 in a radial direction should be formed in consideration of a thickness of the rolling piston 140. That is, as shown in FIG. 13, if a width (P) of the discharge opening 111 in a radial direction is much greater than a sealing thickness (t) of the rolling piston, all of an outer circumferential surface 140*a* and an inner circumferential surface 140*b* of the rolling piston 140 (more specifically, an outer edge and an inner edge) may be disposed within a width range of the discharge opening 111 in a radial direction. This may cause refrigerant leakage, whereby some of a refrigerant discharged from the compression space (S), outside of the rolling piston 140, is introduced into an eccentric portion 23*a*, inside of the rolling piston 140.

Figure 14:
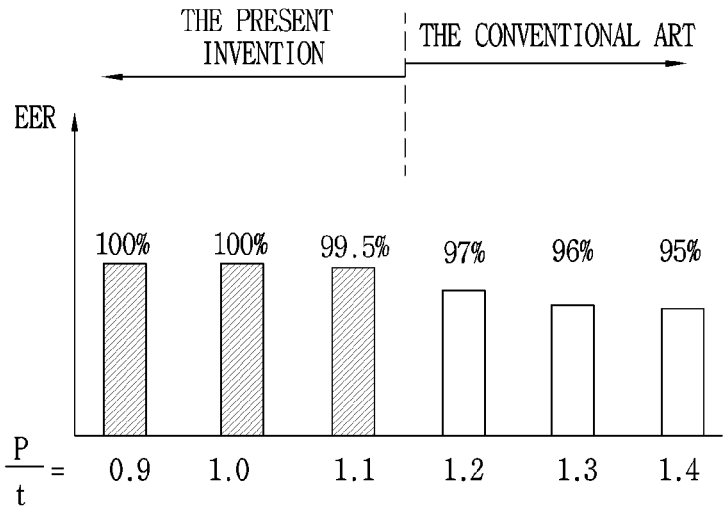
FIG. 14 is a graph illustrating a compressor efficiency (EER) according to a ratio (P/t) of a width (P) of a discharge opening in a radial direction to a sealing thickness (t) of a rolling piston in a radial direction according to the present disclosure.

To prevent such a problem, the width (P) of the discharge opening 111 in a radial direction may be restricted into a ratio (P/t) with respect to a sealing thickness (t) of the rolling piston 140 in a radial direction. It is preferable that the ratio (P/t) is about 1.1 or less. FIG. 14 is a graph illustrating a compressor efficiency (EER) according to a ratio (P/t) of a width (P) of a discharge opening in a radial direction, with respect to a sealing thickness (t) of a rolling piston in a radial direction according to the present disclosure.

As shown in FIG. 14, if the ratio (P/t) is 1.1 or more, the compressor efficiency (EER) is gradually lowered. On the other hand, if the ratio (P/t) is 1.1 or less, the compressor efficiency (EER) is almost constantly maintained. Thus, it is preferable that the discharge opening is formed at a position where the ratio (P/t) is 1.1 or less than.

The compressor according to this embodiment has the following effects.

If the rotor 22 of the motor part 2 and the crank shaft 23 are rotated as power is supplied to the motor part 2, a refrigerant is sucked into the compression space (S) of the cylinder 130 as the rolling piston 140 performs an orbital motion. The refrigerant is compressed by the rolling piston 140 and the vane 150, and is discharged to an inner space of the compressor casing 1 through the discharge opening 111 of the main bearing 110, which is repeatedly performed.

Even if the discharge opening 111 is formed within a range of the compression space (S) in a radial direction, or even if part of the discharge opening 111 is formed out of the range of the compression space (S) in a radial direction, most of the discharge opening 111 is positioned within the range of the compression space (S) in a radial direction. Thus, a discharge guide groove needs not be additionally formed at the cylinder 130. As a discharge guide groove which generates a dead volume is removed from the cylinder 130, a dead volume of the compressor is reduced to enhance compressor efficiency.

Further, the discharge opening 111 is formed within a range of the compression space (S) in a radial direction, and the width (P) of the discharge opening 111 in a radial direction is not much greater than the sealing thickness (t) of the rolling piston 140 in a radial direction. This can minimize excessive communication between the inside and the outside of the rolling piston 140, through the discharge opening 111. Thus, a leakage of a refrigerant discharged from the compression space (S) to the inside of the rolling piston 140 can be reduced. This can prevent a reduction in compressor efficiency.

The discharge opening 111 should be formed within the compression space (S). However, the discharge opening 111 may be at an appropriate position in consideration of a sealing thickness of the rolling piston 140. That is, an outer circumferential wall of the compression space (S) is formed by the inner circumferential surface 130*a* of the cylinder 130, and an inner circumferential wall of the compression space (S) is formed by the outer circumferential surface 140*a* of the rolling piston 140. The rolling piston 140, which forms the inner circumferential wall of the compression space (S) is not a fixed member, but a member which performs an orbital motion. Thus, if the discharge opening 111 is formed too close to the inner circumferential wall of the compression space (S), some of a discharged refrigerant may backflow to the eccentric portion 23*a*, the inside of the rolling piston 140, through the discharge opening 111. This may cause compression loss. Accordingly, the discharge opening 111 should be preferably formed at a position where its width (P) in a radial direction (i.e., a maximum interval between an inner circumferential surface of the discharge opening 111 in a radial direction and an inner circumferential surface of the cylinder) is equal to or less than the sealing thickness (t) of the rolling piston 140.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A compressor, comprising:

a compression space with an annular shape comprising an inner circumferential surface and an outer circumferential surface; and a discharge opening communicated with the compression space, to discharge a refrigerant compressed in the compression space, wherein a first portion of a cross-sectional area of the discharge opening overlaps a portion of a cross-sectional area of the compression space, a second portion of the cross-sectional area of the discharge opening does not overlap the cross-sectional area of the discharge opening, and the ratio of the non-overlapping second portion of the cross-sectional area of the discharge opening to the entire cross-sectional area of the compression space is 0.1 or less, and wherein an annular piston member, which forms the inner circumferential surface of the compression space, and which compresses a refrigerant while performing an orbital motion by contacting the outer circumferential surface of the compression space, is provided at the compression space, and wherein a maximum interval between the outer circumferential surface of the compression space and an inner circumferential surface of the compression space is equal to or less than a sealing thickness of the annular piston member in a radial direction.

2. The compressor of claim 1, wherein the discharge opening is formed in a shape that is a non-perfect circle.

3. The compressor of claim 2, wherein the discharge opening is formed in a shape that is elongated along one direction.

4. The compressor of claim 3, wherein an annular piston member, which forms the inner circumferential surface of the compression space, and which compresses a refrigerant while performing an orbital motion by contacting the outer circumferential surface of the compression space, is provided at the compression space, and wherein a width of the discharge opening in a cross-sectional short-axis direction is 1.1 times or less than a sealing thickness of the annular piston member in a radial direction.

5. The compressor of claim 1, wherein the discharge opening is formed in plurality.

6. A compressor, comprising:

a cylinder with a compression space in an annular shape;

a rolling piston formed in an annular shape, to compress a refrigerant while performing an orbital motion in the compression space when an outer circumferential surface thereof contacts an inner circumferential surface of the cylinder;

a vane slidably inserted into the cylinder, to divide the compression space into a suction chamber and a discharge chamber when the vane contacts the rolling piston; and a plurality of bearings forming the compression space by coupling to upper and lower sides of the cylinder, and having a discharge opening on at least one side thereof, wherein the refrigerant compressed in the compression space is discharged through the discharge opening, wherein a ratio of a width of the discharge opening in a radial direction to a sealing thickness of the rolling piston in a radial direction is 1.1 or less, and wherein a maximum interval between the inner circumferential surface of the cylinder and an inner circumferential surface of the discharge opening is equal to or less than a sealing thickness of the rolling piston in a radial direction.

7. The compressor of claim 6, wherein a cross-sectional area of the discharge opening positioned outwards from the inner circumferential surface of the cylinder and blocked by the cylinder is 10% or less than an entire cross-sectional area of the discharge opening.

8. The compressor of claim 6, wherein the discharge opening is elongated along one cross-sectional direction.

9. The compressor of claim 6, wherein the discharge opening has a circular shape, and wherein a cross-sectional area of an inlet of the discharge opening is smaller than a cross-sectional area of an outlet of the discharge opening.

10. The compressor of claim 6, wherein an edge of the inner circumferential surface of the cylinder contacts the bearing having the discharge opening and has a circular shape.

11. The compressor of claim 10, wherein an edge of the inner circumferential surface of the cylinder contacts the bearing having the discharge opening and has a single inner diameter.

12. A compressor, comprising:

a cylinder with a compression space in an annular shape;

a rolling piston formed in an annular shape, to compress a refrigerant while performing an orbital motion in the compression space when an outer circumferential surface thereof contacts an inner circumferential surface of the cylinder;

a vane slidably inserted into the cylinder, to divide the compression space into a suction chamber and a discharge chamber when the vane contacts the rolling piston; and a plurality of bearings forming the compression space by coupling to upper and lower sides of the cylinder, and having a discharge opening on at least one side thereof, wherein the refrigerant compressed in the compression space is discharged through the discharge opening, wherein an edge of the inner circumferential surface of the cylinder contacts the bearing having the discharge opening and has a circular shape, and wherein a maximum interval between the inner circumferential surface of the cylinder and an inner circumferential surface of the discharge opening is equal to or less than a sealing thickness of the rolling piston in a radial direction.

13. The compressor of claim 12, wherein an edge of the inner circumferential surface of the cylinder contacts the bearings having the discharge opening and has a single inner diameter.

* * * * *